US009587836B2

(12) United States Patent
Begero et al.

(10) Patent No.: US 9,587,836 B2
(45) Date of Patent: Mar. 7, 2017

(54) METHOD FOR OPERATING A GAS HOB, AND GAS HOB

(71) Applicant: E.G.O. Elektro-Geraetebau GmbH, Oberderdingen (DE)

(72) Inventors: Klaus Walter Begero, Bretten (DE); Norbert Gaertner, Ettlingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 311 days.

(21) Appl. No.: 14/330,214

(22) Filed: Jul. 14, 2014

(65) Prior Publication Data

US 2015/0034069 A1 Feb. 5, 2015

(30) Foreign Application Priority Data

Jul. 30, 2013 (DE) ..... 10 2013 214 927

(51) Int. Cl.

| | |
|---|---|
| ***F24C 3/12*** | (2006.01) |
| ***F24C 3/08*** | (2006.01) |
| ***F23N 1/00*** | (2006.01) |
| ***F23N 5/20*** | (2006.01) |
| ***F23N 5/24*** | (2006.01) |

(52) U.S. Cl.

CPC ..... *F24C 3/122* (2013.01); *F23N 1/005* (2013.01); *F23N 5/20* (2013.01); *F23N 5/24* (2013.01); *F24C 3/08* (2013.01); *F24C 3/126* (2013.01); *F23N 2031/22* (2013.01)

(58) Field of Classification Search

CPC .. F24C 3/126; F24C 3/08; F24C 3/122; F23N 5/20; F23N 5/24; F23N 1/005; F23N 2031/22

See application file for complete search history.

(56) References Cited

U.S. PATENT DOCUMENTS

| | | | | |
|---|---|---|---|---|
| 8,001,957 | B2 | 8/2011 | Clauss et al. | |
| 2008/0216810 | A1* | 9/2008 | Clauss | F23N 1/005 126/42 |
| 2009/0250454 | A1 | 10/2009 | Egenter | |

FOREIGN PATENT DOCUMENTS

| | | | |
|---|---|---|---|
| DE | 102006058874 | A1 | 6/2008 |
| DE | 102009047914 | A1 | 3/2011 |
| DE | 102011006736 | A1 | 10/2012 |
| WO | WO 2007/020189 | A1 | 2/2007 |

* cited by examiner

*Primary Examiner* — Alfred Basichas
(74) *Attorney, Agent, or Firm* — Alston & Bird LLP

(57) ABSTRACT

For operating a gas hob having at least two gas burners which can be operated separately and which each have a nozzle, a dedicated gas valve for adjusting a gas supply to the gas burner is associated with each gas burner. The nozzle of a gas burner has an opening cross-section which is 10% to 30% larger than the opening cross-section which is required for the rated power of the gas burner. During normal operation of the gas burner, the associated gas valve is adjusted to a rated throughput. During operation of the gas burner under excess power with full utilization of the full opening cross-section of the nozzle, the gas valve is opened further and adjusted to an excess power throughput.

9 Claims, 1 Drawing Sheet

METHOD FOR OPERATING A GAS HOB, AND GAS HOB

CROSS-REFERENCE TO RELATED APPLICATIONS

This application claims priority to German Application No. 10 2013 214 927.1, filed Jul. 30, 2013, the contents of which are hereby incorporated herein in its entirety by reference.

TECHNOLOGICAL FIELD

The invention relates to a method for operating a gas hob having at least two gas burners, and also to a corresponding gas hob.

BACKGROUND

The individual cooking points or cooking zones of hobs are usually designed for operation at rated power at which they can be operated over a very long period of time. In the case of induction cooking points or cooking zones for example, operation at an excess power for a short period of time is also possible, specifically a so-called boost power, as is disclosed in DE 102006058874 A1 for example.

In view of gas hobs becoming increasingly widespread in the premium sector, it is considered to be desirable to also be able to generate something like an excess power for a short period of time under certain circumstances in this case. Whereas this depends on factors such as operating voltage or operating current and heating or thermal processes in the case of induction hobs, other factors, in particular design factors, play a role in the case of gas hobs with their gas burners.

BRIEF SUMMARY

The invention is based on the problem of providing a method of the kind mentioned above for operating a gas hob, and also of providing a corresponding gas hob, with which method and gas hob the problems of the prior art can be solved and it is possible, in particular, to provide an excess power, which is limited in respect of time, under certain circumstances at a gas hob or at a gas burner too.

This problem is solved by a method and also by a gas hob. Advantageous and preferred refinements of the invention are the subject matter of the further claims and will be explained in greater detail in the text which follows. In the process, some of the features will be explained only for the method or only for the gas hob. However, irrespective of this, they are intended to apply both to the method and also to the gas hob independently. The wording of the claims is incorporated in the content of the description by express reference.

Provision is made for the gas hob to have at least two gas burners which can be actuated and operated separately and which each have at least one nozzle. In the case of gas burners having a plurality of burner rings or nozzles, that nozzle which has the largest burner ring or burner ring diameter with which the so-called main position is taken up is considered in the text which follows. The gas burners advantageously form two different cooking points or cooking zones, respectively. A dedicated gas valve for adjusting a gas supply to the gas burner is associated with each gas burner, preferably only one gas valve or a single gas valve with each gas burner, respectively. Advantageous these are electromotively driven gas valves, for example according to DE 102009047914 A1, which are therefore controlled by an electronic controller for the gas hob and of which the throughput can be correspondingly adjusted. In the process, an opening cross-section, that is to say the maximum throughput, of the gas valve is advantageously considerably larger than the opening cross-section or maximum throughput of a nozzle and therefore passes considerably more gas. Therefore, it may be possible, under certain circumstances, for a gas valve for operating a specific gas burner, even at the abovementioned excess power, to not have to be completely opened or to still have opening reserves. In this case, specifically the opening cross-section of the nozzle has a limiting effect in respect of maximum gas outlet or gas throughput, and therefore also acts as a limiting means for the power which can be generated by the gas burner at most. It is therefore possible for a single type of gas valve to be used for a plurality of gas burners, primarily of different powers.

According to the invention, the nozzle of at least one of the gas burners has an opening cross-section which is larger than the opening cross-section which is required or necessary for a rated power of the gas burner. The opening cross-section can be, for example, 5% or 10% to 30% larger, under certain circumstances even up to 50% larger. Therefore, the theoretically possible power at this gas burner with this nozzle can also be increased by 5% to 50%. During normal operation of the gas burner, that is to say at normal or rated power or the power which is possible over the long term, the associated gas valve is adjusted to a rated throughput. The rated throughput is that throughput at which the rated power is generated at the gas burner with the nozzle and for which the gas burner was designed, for example also so as to match the distribution of the cooking points or cooking zones on the gas hob or the size of a burner cover or the shape of the pot support. During excess power operation of the gas burner, that is to say at the abovementioned elevated power, the gas valve is opened further and is adjusted to an excess power throughput at the gas valve itself. Therefore, a large portion of the opening cross-section or, under certain circumstances, even the full opening cross-section of the nozzle can be utilized to a far greater extent, under certain circumstances even to the maximum extent. The full opening cross-section of the nozzle is determined such that the boundary conditions for combustion quality at this operating point are maintained when the gas is flowing out for combustion purposes.

It is therefore possible to use the nozzles of the gas burner only partially in respect of their throughput during normal operation or operation at rated power, in particular to generate the rated power. In order that a reserve is still available for the excess power, the opening cross-section of the nozzles is even larger, and owing to greater throughput of gas at the gas valve, more gas can flow out at the gas burner for a higher power or for the excess power.

During excess power operation of the gas burner, the opening cross-section of the nozzle can be utilized to a greater extent. In this case, the opening cross-section of the nozzle can advantageously be fully utilized, with the result that an even higher power would not be possible. This allows the boundary condition for combustion quality at this operating point to be satisfied, and therefore allows good combustion during excess power operation. Therefore, the nozzle, together with its opening cross-section, can be designed such that good and clean combustion takes place at the excess power.

In one refinement of the invention, a check can be made to determine how many gas burners of the gas hob are active.

In order to satisfy hygiene conditions, in particular in respect of air pollution or relatively clean combustion at the gas hob, provision can be made for a gas burner to be able to be operated at excess power only when at least one further gas burner is in operation at, at most, its rated power. The further gas burner is preferably operated at a lower power than its rated power. In this case, the power should be below its rated power by the difference between the rated power and the excess power in the other gas burner. In this way, a summed rated power will be maintained overall.

In one refinement of the invention, all of the gas burners of the gas hob can be operated only in such a way that the sum of the momentary powers of all of the operated gas burners overall does not exceed the sum of the rated powers of the operated gas burners. The abovementioned hygiene condition is again satisfied in this way. Whereas a maximum electrical energy supply in addition to thermal problems in the induction hob itself are limited during operation of the abovementioned induction hob, for example by protection of the connected external conductors of a domestic supply system with a 16 amp fuse at most, it is, in contrast to this, at least theoretically possible to generate very high burner powers or powers in a gas hob by means of enabling a specific gas throughput. However, for reasons of admission and also for reasons of the abovementioned hygiene condition, burner powers of any desired level cannot be realized on a gas hob in practice.

The gas hob advantageously has more than two gas burners, wherein the operating state of all of the gas burners is checked continuously or permanently. In this case, the number of gas burners which can be operated or are operated at excess power is always one less than the number of gas burners which are operated at all. This therefore means that even one gas burner alone must not be operated at excess power. The abovementioned condition of the sum of the rated powers of the operated gas burners specifically can be satisfied only in this way. In this case, specifically the abovementioned hygiene condition is obviously not satisfied. In order that the other gas burners can operate at excess power, at least one gas burner has to operate below its rated power, advantageously by the difference sum by which the other gas burners exceed their rated power.

In an advantageous refinement of the invention, a user should be provided with an indication of when a gas burner is operating or is operated at excess power. This may also apply for operation of another gas burner at a correspondingly reduced power. An indication can be made optically and/or acoustically.

It is possible and advantageous to limit the operation of a gas burner at excess power in respect of time. The operation can last, for example, a maximum of 10 minutes, advantageously for a maximum of 5 minutes. This is sufficient for the majority of cooking processes to which an excess power of this kind is applied, for example in order to bring to the boil large pots of water for pasta or potatoes in a short period of time or in order to heat a pan to a high temperature in order to pan-fry steaks. Possible excessive heating at the gas burner itself can be avoided by limiting the time. In the same way, restricting the operation of another gas burner, which then has to be operated by the corresponding difference below its rated power, can then be cancelled again.

The gas valves are advantageously provided with stepper motors or are driven by stepper motors, according to the abovementioned document DE 102009047914 A1. A maximum permissible step number, which ensures the hygiene values are met for the individual gas burners at their rated thermal loading, is stored internally in an electronics system or a controller for the gas hob. In order to ensure that this value or this step width is not exceeded during individual operation, that is to say when only a single gas burner of the gas hob is operated, regular or cyclical checks can be made. To this end, so-called reference runs of the gas valve can be performed.

The controller of the gas hob always knows how many and which gas burners are operated and at which power level. Therefore, the controller can also determine without fault how many and which gas burners are active and, respectively, whether a gas burner is available for an excess power. In this case, provision can also be made, for the method, for, given a corresponding input to the controller for an excess power on one gas burner, the power of another gas burner to be equally automatically reduced. As an alternative, this can be indicated and provided to an operator as an option, and therefore an operator once again has to confirm that, in order to achieve an excess power on one gas burner, the power of another gas burner will be reduced in order to ensure the condition of operation at the maximum summed rated power of the gas burners.

Exemplary values for a throughput of the nozzles are a diameter of 1.05 mm for a power of 2 kW, and 1.24 mm for a power of 3 kW. A gas valve which is used in this case can have, for example, a maximum opening cross-section of 4 mm, that is to say considerably above diameter. If the nozzles of the two gas burners are now replaced by a larger nozzle with an opening cross-section of 1.39 mm and a smaller nozzle with an opening cross-section of 1.17 mm, the respective burner power can be increased by approximately 25%. The larger gas burner can therefore operate at 3.75 kW at most and the smaller gas burner can operate at 2.5 kW at most. For this purpose, the power of another gas burner also has to be reduced by the corresponding value of 0.75 kW or 0.5 kW.

These and further features are evident not only from the claims but also from the description and the drawings, wherein the individual features can each be implemented in their own right or in conjunction with one another in the form of sub-combinations in an embodiment of the invention, and in other fields, and may represent advantageous embodiments as well as embodiments which are patentable in their own right and for which protection is claimed here. The subdivision of the application into individual sections as well as sub-headings does not restrict the general applicability of the statements made therein.

BRIEF DESCRIPTION OF THE SEVERAL VIEWS OF THE DRAWINGS

Exemplary embodiments of the invention are schematically illustrated in the drawings and will be explained in greater detail in the text which follows. In the drawings.

DETAILED DESCRIPTION

Figure 1:
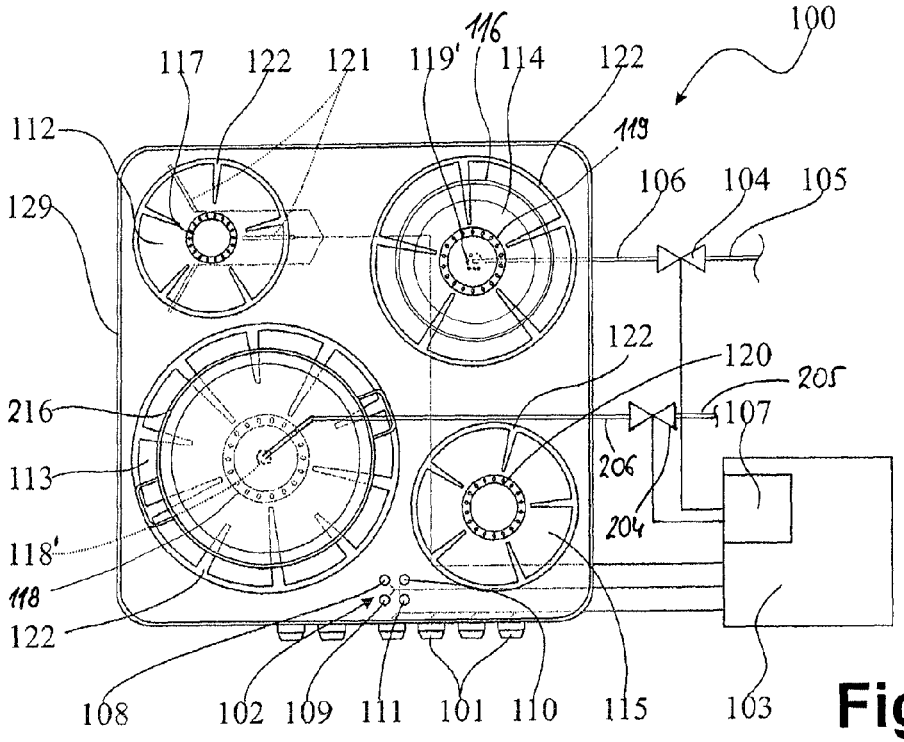
FIG. 1 shows a plan view of a gas hob according to the invention.

FIG. 1 shows a plan view of an exemplary embodiment according to the invention of an electronically controlled gas hob 100. The figure specifically shows a hob plate 129 with four cooking points 112 to 115 which could also be seen as individual cooking zones, each for one cooking vessel. A cooking vessel 216 is arranged on the cooking point 113, and a cooking vessel 116 is arranged on the cooking point 114. The cooking vessels 116 and 216 each stand on support grids 122 of the cooking points 112 to 115 in this case. Each cooking point has an associated gas burner 117 to 120 in the centre. Furthermore, the gas hob 100 has a plurality of operator control elements 101, an indicator device 102 and also a control unit 103. A central controller 103 which controls and regulates all of the functions of the gas hob 100 is particularly advantageous. Part of the control unit 103 is an electronic gas controller 107, which controls all gas valves of the gas hob 100, the gas valves advantageously being of identical construction.

The desired cooking stages for the associated cooking points 112 to 115 or the gas burners 117 to 120 thereof can be set by means of the operator control elements 101. The desired cooking stage of a cooking point 112 to 115 is transmitted from the associated operator control element 101 to the controller 103, in particular to the gas controller 107. The gas controller then controls, for example for the third cooking point 114, the gas valve 104 such that a burner power which corresponds to the desired cooking stage is set for the associated burner 119. The gas supply is illustrated using the example of cooking points 114 and 113. Gas is supplied to the cooking point 114 comprising the gas burner 119 and, respectively, to the cooking point 113 comprising the gas burner 118 via a gas supply line 105 and, respectively, 205, the gas valve 104 and, respectively, 204 and the gas feed line 106 and, respectively, 206. The other gas valves are not illustrated but are connected in the same way.

Figure 3:
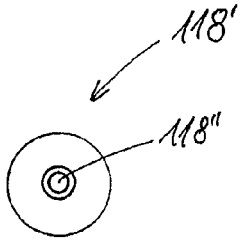
FIG. 3 shows a plan view of an extremely enlarged nozzle of a gas burner from FIG. 1.

Furthermore, a nozzle 118' of the gas burner 118 and also a nozzle 119' of the gas burner 119 are illustrated using dotted lines. The nozzles are of conventional design and are covered by corresponding removable covers of the gas burners. A plan view of a nozzle 118' of this kind with a central nozzle hole 118" is illustrated in FIG. 3. The round opening cross-section can be seen at the nozzle hole, wherein a diameter lies in the abovementioned range and is at most 2 or 3 mm, advantageously between 1 mm and 1.5 mm.

Figure 2:
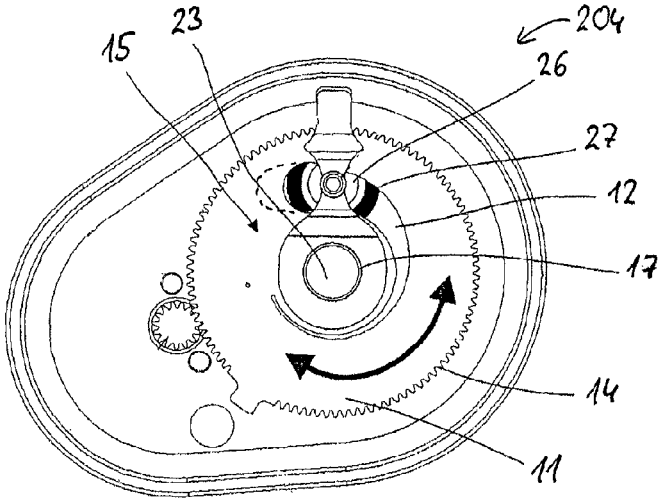
FIG. 2 shows a detail of a gas valve with the opening cross-section illustrated.

FIG. 2 illustrates a gas valve 204 for the cooking point 113 and, respectively, the gas burner 118 in section and in plan view, as is known per se from the abovementioned document DE 102009047914 A1. The gas valve 204 has a rotor disc 11 with a toothed ring 14 on the outside. The rotor disc 11 is rotatably mounted on a shaft 23 by means of a disc hub 17 and is driven by an electric motor, preferably by a stepper motor, by virtue of a pinion at the top left. A region 15 does not have any openings, whereas, on the right-hand side, an opening 12, together with an output opening 26 and a ring seal 27 around it, defines a gas throughput or opening cross-section of the gas valve 204. Reference is made to DE 102009047914 A1 in respect of the importance of the special shape of the opening 12.

In order to now design the gas valve 204 for excess power operation, provision can be made, for normal operation of the gas burner 118, for the rotor disc 11 to be located in the position which is rotated somewhat further in the anticlockwise direction and which is illustrated using dashed lines for the opening 12. It is clear that there is now a narrower region of the elongate opening 12 above the output opening 26 and an opening cross-section is smaller. This can also be the maximum open or end position for rated operation of the gas burner 118, even if there is still a form of power reserve available. The rated power at the gas burner 118 which is supplied by the gas valve 204 is 3 kW in this case. By further rotation of the rotor disc 11 in the clockwise direction into the position which is illustrated using solid lines, more gas is passed for an excess power throughput and the excess power of 3.7 kW is generated at the gas burner 118 and, respectively, the nozzle 118'. In this case, this excess power throughput can be matched precisely to the opening cross-section of the associated gas burner 118 and, respectively, of the nozzle 118', for example by as much gas being passed in this case as can flow out of the nozzle 118' at most. Further opening of the gas valve 204 would not generate any higher power at the gas burner 118 and, respectively, at the nozzle 118' either.

The gas valve 104 for the gas burner 119 can also be designed in a corresponding manner. However, since the power of the gas valve during rated operation is intended to be, by way of example, only 2 kW and therefore considerably less than the 3 kW of the gas burner 118 of the cooking point 113, an end position of the rotor disc according to FIG. 2 can produce an even smaller passage cross-section. In this case, an excess power of at most 2.5 kW can be generated by somewhat further rotation of the rotor disc. However, the controller 103 ensures that the condition of the sum of all the powers being at most the sum of the rated powers of the operated burners is always complied with.

The indicator device 102 or the LED indicators 108 to 111 of the indicator device indicate whether a cooking point 112 to 115 is being operated at excess power, for example by flashing or extra-bright illumination. The reduction in power of a cooking point can likewise be indicated, this occurring because another cooking point is intended to be operated at excess power.

That which is claimed:

1. A method for operating a gas hob comprising:

at least two gas burners which can be actuated and operated separately from each other, wherein each of said gas burners comprises at least one nozzle; and a dedicated gas valve for adjusting a gas supply to each of said gas burners, wherein said nozzle of at least one of said gas burners comprises an opening cross-section being larger than an opening cross-section which is required for a rated power of said gas burner, wherein, during normal operation of said one of said gas burners, an associated gas valve to said one of said gas burners is adjusted to a rated throughput, and, during operation of said one of said gas burners at excess power with full utilization of a full opening cross-section of said nozzle, said gas valve is opened further and adjusted to an excess power throughput, wherein said gas burners of said gas hob are operated in such a way that a sum of momentary powers of all of said operated gas burners does not exceed a sum of rated powers of said operated gas burners, and wherein exactly one gas valve is provided for each gas burner having at least one nozzle.

2. The method according to claim 1, wherein a check is made to determine how many of said gas burners of said gas hob are active, and one said gas burner can be operated at excess power only in an instance in which at least one further of said gas burners is in operation at its rated power.

3. The method according to claim 2, wherein said gas burner is operable at excess power only in an instance in which at least said further gas burner is in operation at a lower power being below its rated power by a difference between said rated power and said excess power in said other gas burner.

4. The method according to claim 1, wherein said gas hob comprises more than two said gas burners and said operating state of all of said gas burners is checked, wherein the number of gas burners which can be operated at excess power is always one less than the number of gas burners which can be operated at all.

5. The method according to claim 4, wherein at least one said gas burner is operated at rated power in order to allow operation of said other gas burners at excess power.

6. The method according to claim 1, wherein operation at least of one said gas burner which is operated at excess power is optically or acoustically indicated.

7. The method according to claim 1, wherein operation of said gas burner at excess power is limited in respect of time.

8. The method according to claim 7, wherein said operation of said gas burner at excess power is a maximum of 10 minutes.

9. The method according to claim 1, wherein said opening cross-sections of said nozzles of said gas burners are 5% to 30% greater than said opening cross-sections as rated throughput for their rated power.

* * * * *